United States Patent [19]

Heim

[11] 4,255,817

[45] Mar. 17, 1981

[54] HEAT INSULATIVE MATERIAL ARTICLES COMPRISING ARAMID FIBERS

[76] Inventor: John N. Heim, 10183 Amestoy St., Granada Hills, Calif. 91344

[21] Appl. No.: 7,356

[22] Filed: Jan. 29, 1979

[51] Int. Cl.[3] ..... A41D 13/00; A41D 13/04; A62B 17/00; A62D 5/00

[52] U.S. Cl. ..... 2/2; 2/48; 2/49 R; 2/51; 428/213; 428/218; 428/236; 428/255; 428/267; 428/474.7; 428/920

[58] Field of Search ..... 2/2, 49 R, 48, 56, 51; 428/213, 218, 236, 267, 474.7, 920

[56] References Cited

U.S. PATENT DOCUMENTS

| | | | |
|---|---|---|---|
| 3,744,534 | 7/1973 | Henry et al. | 2/2 |
| 3,953,893 | 5/1976 | Byrnes | 2/51 |
| 4,030,139 | 6/1977 | Sonntag | 2/51 |
| 4,151,800 | 5/1979 | Dotts et al. | 428/920 |

OTHER PUBLICATIONS

Du Pont Technical Information Bulletin K-1, Kevlar, Dec. 1974.

*Primary Examiner*—James C. Cannon
*Attorney, Agent, or Firm*—Cislo & O'Reilly; Cislo & O'Reilly

[57] ABSTRACT

A heat insulative protector or the like, comprising at least a layer of a synthetic fabric of an organic fiber of copolyamide, wherein the fibers are woven or formed into a fabric. Articles such as hot pads, protective coverings, aprons, garments, or the like, are fabricated of, in addition to a closely interwoven fabric layer, another superpositioned layer of like fibers punched into a low density, high bulk flannel with a synthetic rubber, fire resistant coating. Such combination provides, for example, an apron for commercial and/or industrial use with a high protective quality to the wearer thereof.

4 Claims, No Drawings

HEAT INSULATIVE MATERIAL ARTICLES COMPRISING ARAMID FIBERS

BACKGROUND OF THE INVENTION

In commercial and industrial establishments, for example, fast food chain restaurants, it becomes necessary, especially with the onslaught of OSHA regulations, to provide protective wear for short-order cooks and the like in the form of aprons which protect the wearer, not only against radiated heat, but also from splashed hot grease and other oils.

In other fields of application, a heat insulative material or fabric is ideal to cover irons to act as hot pads or, generally, to provide protection against heat in the domestic setting.

In the prior art, means of providing the afore-alluded-to-protection have either involved materials which have been incapable of providing the protection desired or have necessitated cumbersome expedients which have not been conducive to the end results desired.

With the herein-disclosed invention, a synthetic fiber fabric is provided, which is of relatively light weight, high durability, offering durability and great, heat insulative protection for domestic uses and a work apron or the like, which is fabricated in a unique and special manner so as to achieve a wide variety of desirable and selected features.

OBJECTS AND SUMMARY OF THE INVENTION

An object of the invention is to provide a heat insulative protector or the like, for various uses, wherein the protector is fabricated of a particular synthetic fiber.

It is another object of the invention to provide a fabric made of synthetic fibers of a certain character which may be fabricated into various articles to provide heat protection.

It is another still more important object of the invention to provide a heat insulative protector made of a synthetic fabric, wherein said fabric is made from fibers of an organic fiber of copolyamide.

It is still another, even more specific object of the invention to provide a heat insulative protector or the like, wherein a garment may be fashioned of a combination of fabrics, utilizing and employing a unique, organic polymer, so as to provide satisfactory protection against heat and attendant hazards.

It is still another, even more important and even further specific object of the invention to provide a protective covering, apron, garment, or the like, wherein a first portion employs a closely woven synthetic fiber and wherein the lower portion thereof is composed of another synthetic fiber portion, wherein the second portion is coated with a fire resistive, rubber-like coating and wherein said second portion is made of a low density, high bulk fabric.

It is still another and even further, more specific object of the invention to provide a protective apron or the like for commercial and/or industrial usage, wherein said apron employs an upper first portion of interwoven synthetic fibers wherein a lower portion is overlaid with a low density, high bulk, punched flannel composed of the same synthetic fiber which is coated with a synthetic, fire retardant coating.

In an exemplary embodiment, the invention is directed to a protective covering, apron, garment, or the like, comprising the combination of a first portion composed of a layer of synthetic fabric of an organic fiber of copolyamide, having the structure

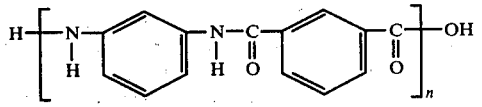

and a second portion of a like fiber, having a coating of a fire-resistant material thereon. In another application of the inventive concept, a heat insulative protector or the like is fabricated of the above-described fibers, which are closely interwoven into a fabric of at least 0.005" thickness.

These and other objects of the invention will become apparent from the hereafter following commentary.

DESCRIPTION OF THE BEST EMBODIMENTS CONTEMPLATED

The invention pertains to the provision, in the simplest application, of a layer of a material made from a fiber, which is an organic one and is a copolyamide having the structure

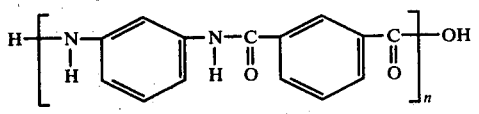

Said material is generally available under the "Nomex" trademark of the "DUPONT" Company and is generally referred to as an Aramid fiber.

In the application of the invention, as for example, a hot plate, barbecue mitt or low hazard application with respect to heat, a single layer of closely interwoven fabric, made of the organic fibers of copolyamide and having a thickness of at least 0.005", will suffice. Thus, in low heat, low hazard applications, the layer of fabric need only be placed intermediate a heat and/or hazardous heat source and the object or person to be protected.

However, in a specific application of the inventive concept as to commercial and/or industrial work aprons of the type that may be encountered in fast food chain restaurants, the provision of a single layer as afore-described will not produce the same beneficial results as where the hereinafter following expedient is resorted to.

In the fabrication of an apron or the like, of the type normally encountered having an upper body portion and a lower body portion, wherein a neck strap is provided to generally encircle the neck of the wearer and the lower body portion employs ties or straps to snugly follow contours of the lower body portion of a wearer, a single layer of "NOMEX" fabric, of the duck type and comprising the closely interwoven fibers, is cut in the general configuration of a conventional apron design.

Obviously, as those of ordinary skill in the garment manufacturing art will recognize, the apron size and/or configuration and shape is not a part of the invention, nor is the specific means of retaining same on the body of the wearer a part of the invention.

Once a single layer of "NOMEX" cloth has been fabricated in the ultimate configuration desired, a lower portion of the garment (to decrease overall costs and to facilitate mobility) is provided with a composite layer or second portion, which is made of the aramid fiber, but wherein said fiber is fabricated by a punch process into a low density, high bulk flannel. As those in the industry will recognize, there are several methods of fabricating either natural or synthetic fabrics.

A fiber may be spun into threads and then woven into a fabric as is contemplated for the overall fabric used in the simplest heat applications and as is used in formulating the basic apron or garment.

A second expedient of forming fabrics is to punch individual fibers into what is referred to as a low density, high bulk flannel. The second portion as afore-described, is made in the afore-described manner. The low density, high bulk flannel may be referred to as a batting and will be in the area of ten ounces per square yard and will generally be within the thickness of 0.150–0.155".

The basic fabric, or duck fabric, which is of a close weave, will have a warp of 16-3 and a filling of 16-3 and also have a weight per square yard of ten ounces. With respect to the duck-like fabric, the warp direction is 214 pounds, whereas the fill direction is 82 pounds, as established by Federal Test Methods Standard 191, Method 5136.

The batting or flannel-like fabric is coated, in the practice of this invention, with a fire-resistant neoprene, or other rubber-like, fire-resistant material, wherein the coating is within the range of 0.005–0.010".

The coated, batting layer is then sewn to the lower portion of the apron, garment, or the like, with the batting, uncoated side exterior of the first layer or portion formed by the "NOMEX" closely interwoven fiber material alone. The fibers used for sewing are also of a "NOMEX" Aramid fiber, so as to provide the same heat resistance in the means of attachment as is found in the basic materials making up the protective garment or other article.

In some instances, the batting or flannel-like fabric may be of a lesser weight then the ten ounce per square yard where low hazard use and, consequently, low heat application is desired, and in some instances backing of polypropylene scrim, or the like, may be used to form the flannel-like fabric through the punching process for low density, high bulk character desired for applications of the invention using same.

A work apron, or the like, has been fabricated, utilizing a first fabric layer or portion of a "NOMEX" duck fabric, wherein the fabric has been treated with a water repellent such as ZEPEL water repellent, or any similar type of finish. It should be understood that the water repellency is not part of the invention and is merely applied to the fabric, so as to make its use in a commercial or industrial application more desirable, not only from a water repellency standpoint, but also from an aesthetic and cleanliness standpoint. To the configured garment was applied the punched fiber, low density, high bulk flannel, which had been coated with a fire-resistant neoprene and adhered or sewn to the lower portion of the apron or garment with threads of an Aramid fiber.

The work apron was found to provide high protection against radiated heat, splashed grease, and general hazards encountered in fast food chain and/or quick order, grill-like restaurant services. Additionally, the work apron was of aesthetically pleasing appearance, was long lasting, and performed better than any known work apron of its type.

While specific description of the inventive concept has been given, same has been for illustrative purposes only. Those of ordinary skill in the art will recognize various changes and modifications and all such changes and modifications are intended to be covered by the appended claims and will not depart from the essence of the invention as set forth hereinbefore and in the appended claims.

I claim:

1. A protective covering, apron or garment comprising the combination: a first portion comprising a layer of woven synthetic fabric of an organic fiber of copolyamide having the structure:

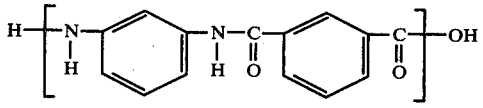

and a second portion of a like fiber having a coating of fire-resistant neoprene thereon, said first portion being fabricated of closely interwoven fibers and said second portion being fabricated of punched fibers forming a low density, high bulk flannel and wherein said first portion is at least 0.005 inch thick and said second portion is within the range of 0.150–0.155 inch thick and said coating is within the range of about 0.005–0.010 inch thick.

2. A protective covering, apron, garment or garment in each instance, in accordance with claim 1 wherein said first portion forms the overall configuration of said protective covering, apron, garment, or the like, and said second portion is superposed over the lower portion thereof.

3. A protective covering, apron, garment or garment in each instance, in accordance with claim 2 wherein said second portion is sewn to said first portion with threads fabricated of said fiber.

4. A protective covering, apron, or garment in each instance comprising the combination of a first portion in the general configuration of the covering, apron or garment and being fabricated of at least a 0.005 inch thick layer of woven synthetic fabric of an organic fiber of copolyamide having the structure:

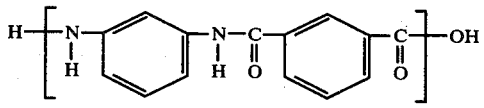

a second portion superposed over at least the lower portion of said first portion, said second portion being fabricated of punched fibers of said organic fiber of copolyamide having the above-identified structure and being formed of a low density, high bulk flannel within the thickness range 0.150–0.155 inch; and an integral layer of fire-resistant neoprene forming a backing for said second portion and being adjacent to the surface of said first portion.

* * * * *